US010266184B2

(12) United States Patent
Grip

(10) Patent No.: US 10,266,184 B2
(45) Date of Patent: Apr. 23, 2019

(54) SUPPORT SYSTEMS AND METHODS FOR A TRANSPORTATION SYSTEM

(71) Applicant: THE BOEING COMPANY, Chicago, IL (US)

(72) Inventor: Robert Erik Grip, Rancho Palos Verdes, CA (US)

(73) Assignee: The Boeing Company, Chicago, IL (US)

( * ) Notice: Subject to any disclaimer, the term of this patent is extended or adjusted under 35 U.S.C. 154(b) by 198 days.

(21) Appl. No.: 15/413,476

(22) Filed: Jan. 24, 2017

(65) Prior Publication Data

US 2018/0208216 A1 Jul. 26, 2018

(51) Int. Cl.
*B61B 13/10* (2006.01)

(52) U.S. Cl.
CPC ..... *B61B 13/10* (2013.01)

(58) Field of Classification Search
CPC ..... B61B 13/10; B61B 5/00; B61B 13/122; B61B 13/08
USPC ..... 104/117
See application file for complete search history.

(56) References Cited

U.S. PATENT DOCUMENTS

| | | | | |
|---|---|---|---|---|
| 1,064,887 A * | 6/1913 | Clapp | E01B 25/18 | 104/115 |
| 3,859,682 A * | 1/1975 | Sulkiewicz | E01D 2/00 | 104/124 |
| 3,861,319 A * | 1/1975 | Gelhard | B61B 13/10 | 104/123 |
| 5,653,175 A * | 8/1997 | Milligan | B60L 13/04 | 104/138.1 |
| 8,214,957 B2 * | 7/2012 | Miettinen | E01D 1/00 | 14/3 |
| 2018/0058907 A1 * | 3/2018 | Kn | G01F 25/0007 | |

OTHER PUBLICATIONS

"Hyperloop Alpha," http://www.spacex.com/sites/spacex/files/hyperloop_alpha-20130812.pdf.

* cited by examiner

*Primary Examiner* — Mark T Le
(74) *Attorney, Agent, or Firm* — Joseph M. Butscher; The Small Patent Law Group, LLC

(57) ABSTRACT

A transportation system includes a tube defining an interior channel. A vehicle is configured to travel through the interior channel. At least one tension support couples the tube to ground. The tension support(s) exerts tension force into the tube. The tension force exerted into the tube reduces deflection of the tube when the vehicle travels through the interior channel over the tension support(s).

36 Claims, 5 Drawing Sheets

SUPPORT SYSTEMS AND METHODS FOR A TRANSPORTATION SYSTEM

FIELD OF EMBODIMENTS OF THE DISCLOSURE

Embodiments of the present disclosure generally relate to transportation systems, and, more particularly, to systems and methods of supporting vehicles that travel through tubes supported above a surface of the ground.

BACKGROUND OF THE DISCLOSURE

Magnetic levitation is a form of transportation in which a vehicle is moved via magnetic levitation without contacting the ground. As such, the vehicle is able to move without experiencing rolling friction with the ground or support rails, for example. In general, the vehicle travels along a guideway via magnets that generate lift and propulsion, thereby reducing friction and allowing travel at high speeds.

Currently, magnetic levitation systems are being developed in which a vehicle travels through vacuum tubes, in order to reduce the effects of aerodynamic drag on the vehicle. As such, the speed and operational efficiency of the vehicle are increased through the elimination or reduction of aerodynamic drag with respect to the vehicle. The magnetic levitation system reduces static and rolling friction with respect to the vehicle, while the vacuum tube reduces aerodynamic drag. A reduced friction vehicle system, such as a magnetic levitation vehicle that travels through a vacuum tube, may be positioned underneath a ground surface, and/or may be supported over the ground surface.

The tube may vertically deflect as the vehicle travels therethrough. The deflections of the tube under vertical load applied by the vehicle traveling therein may be unsettling to passengers. For example, a magnetic levitation vehicle system may include vacuum tubes constructed of steel. For a tube of a given diameter sized such that one atmosphere (atm) of pressure creates a stress equal to an allowable stress divided by a safety factor, for example, the deflections for a tube with supports spaced 300 feet apart is approximately 0.095 inches. Such a magnitude of deflection may cause discomfort to passengers aboard the vehicle traveling through the tube.

In order to reduce tube deflections, a tube of increased strength and robustness may be used so that the bending moment of inertia is increased. If the diameters of the tubes are held constant, the amount of weight is inversely proportional to the deflections. Thus, in order to achieve reduced deflections to 0.045 inches, for example, the tube would need to be twice the weight. As can be appreciated, tubes of increased size and weight increase the overall cost of the transportation system.

As another option, the spacing between support columns that support the tube above the ground may be reduced. Notably, tube deflections are proportional to the fourth power of the spacing between support columns. As an example, by moving support columns closer by sixteen percent (to 252 feet instead of 300 feet), deflections may be reduced to 0.045 inches. Again, however, reducing the spacing between support columns requires an increased number of support columns, which increases the overall cost of the transportation system.

Alternatively, the support columns may be eliminated by locating the tubes below the ground surface through tunneling. However, the process of tunneling substantially increases the cost of the transportation system. Overall, tunnels are more expensive than above ground systems. Additionally, pressures exerted into the tubes that are below ground are typically greater than one atmosphere, which is the pressure exerted upon an above ground tube. As such, the increased pressure may require stronger (and expensive) tubes to be used.

SUMMARY OF THE DISCLOSURE

A need exists for a system and method for supporting an above ground tube that reduces deflections as a vehicle travels through the tube. A need exists for a system and method for efficiently and cost-effectively reducing tube deflections of an above ground tube-based transportation system.

With those needs in mind, certain embodiments of the present disclosure provide a transportation system that includes a tube defining an interior channel. A vehicle is configured to travel through the interior channel. At least one tension support couples the tube to ground. The tension support(s) exerts tension force into the tube. The tension force exerted into the tube reduces deflection of the tube when the vehicle travels through the interior channel over the tension support(s).

In at least one embodiment, the transportation system includes at least two support columns. The tube extends between the two support columns. The tension support(s) couples to the tube between the support columns. The support columns are configured to carry compression loads, and the tension support(s) is configured to carry tension loads. The tension support(s) is lighter and smaller than each of the support columns.

In at least one embodiment, a vacuum is formed in the interior channel. The vacuum reduces aerodynamic drag on the vehicle as the vehicle travels through the interior channel. The vehicle may be a magnetic levitation vehicle.

In at least one embodiment, the tension support(s) includes an anchor secured to the ground, a tensioning actuator coupled to the anchor, and a tensioning member having a first end coupled to the tensioning actuator, and a second end coupled to the tube.

The transportation system may include a tension control unit in communication with the tension support(s). The tension control unit is configured to adjust the tension force of the tension support(s) based on a position and weight of the vehicle within the interior channel of the tube.

A plurality of sensors may be coupled to the tube. The sensors are configured to detect a location of the vehicle within the interior channel. The tension control unit may be in communication with the sensors.

At least one motion sensor may be secured to the ground proximate to the tension support(s). The motion sensor is configured to detect motion of the ground. The tension control unit is in communication with the motion sensor and is configured to adjust the tension force based on the motion of the ground as detected by the motion sensor.

In at least one embodiment, the tube is cambered before being coupled to the tension support(s). The tension force exerted into the tube by the tension support(s) straightens the cambering of the tube.

In at least one embodiment, the tube includes an outer tube surrounding an inner tube. The outer tube may be separated from the inner tube by a space. The tube may also include a plurality of stiffeners within the space between the outer tube and the inner tube. The plurality of stiffeners may define a plurality of sealed compartments. At least one fluid sensor may be positioned within at least one of the plurality of sealed compartments.

In at least one embodiment, the space is divided into a plurality of vacuum sections. Each of the plurality of vacuum sections includes a different degree of vacuum. The different degrees of vacuum within the plurality of vacuum sections are configured to set a vacuum within the interior channel to a desired level.

Certain embodiments of the present disclosure provide a method of supporting a transportation system. The method includes coupling a tube defining an interior channel to ground with at least one tension support (wherein a vehicle is configured to travel through the interior channel), exerting tension force into the tube through the coupling, and reducing deflection of the tube through the exerting when the vehicle travels through the interior channel over the at least one tension support.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide a transportation system that includes a tube longitudinally positioned on a plurality of columns, and a tension support member coupled to the tube and a support structure that secures the tension support member to the ground. In at least one embodiment, the tube is formed having a camber. The tension support member exerts tension into the tube, which eliminates or otherwise reduces the cambering of the tube.

In at least one embodiment, the tube includes a double-walled construction. For example, the tube includes an inner tube surrounded by an outer tube. One or more stiffeners may be used between the inner and outer tubes. One or more sensors may be secured between the inner and outer tubes. The sensors may be used to monitor the structural integrity of the tube.

Figure 1:
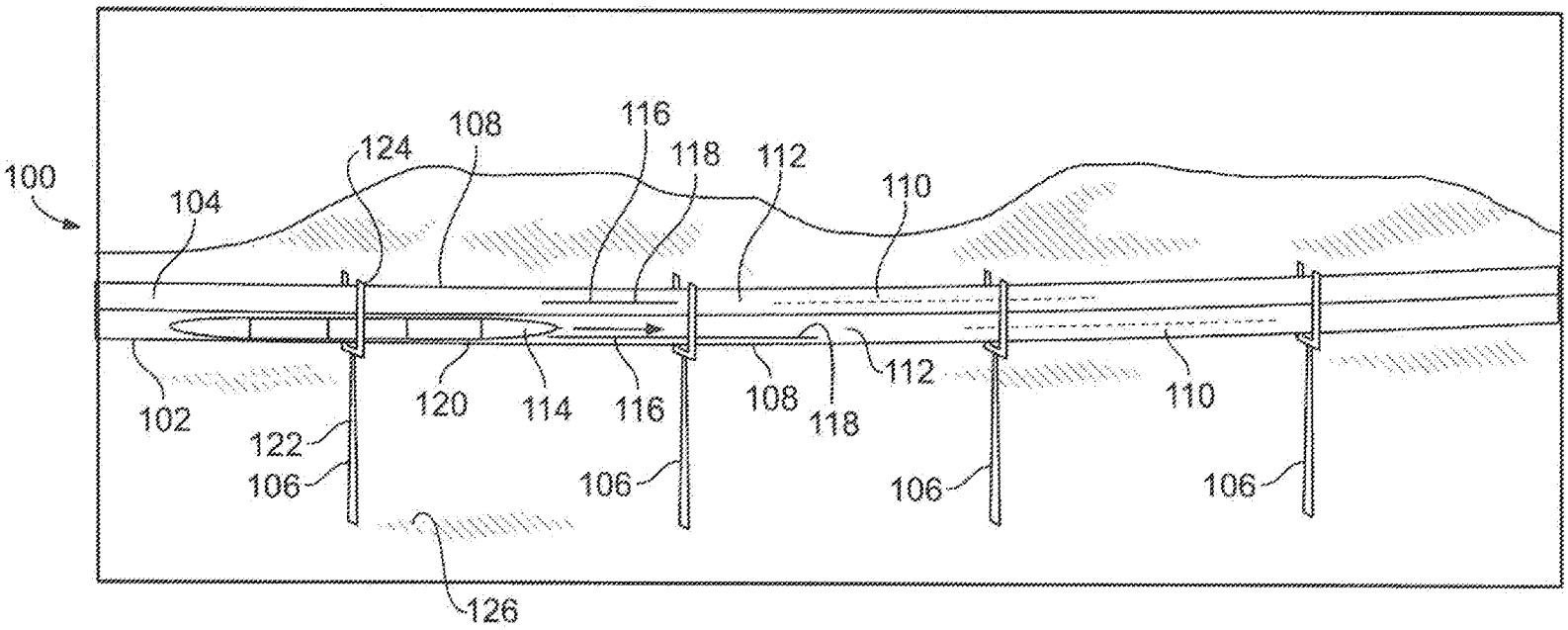
FIG. 1 illustrates a lateral view of a transportation system, according to an embodiment of the present disclosure.

FIG. 1 illustrates a lateral view of a transportation system 100, according to an embodiment of the present disclosure. The transportation system 100 includes tubes 102 and 104 supported above ground by a plurality of support columns 106. As shown, the tube 104 is secured directly over the tube 102. Alternatively, the tubes 102 and 104 may be secured together in a side-by-side relationship. Optionally, the transportation system 100 may include more or less tubes than shown. For example, the transportation system 100 may include only the tube 102 or the tube 104.

Each tube 102 and 104 includes an outer circumferential wall 108 that extends longitudinally along a longitudinal axis 110. The wall 108 defines a hollow interior channel 112 that is configured to allow a vehicle 114 to pass therethrough. In at least one embodiment, the interior channel 112 is a vacuum channel, which eliminates or otherwise reduces aerodynamic drag on the vehicle 114.

Guideways 116 may be secured within each interior channel 112. The guideways 116 are configured to support the vehicle 114, which is conveyed along the guideways 116. In at least one embodiment, the guideways 116 include guideway magnetic levitation components 118, such as electromagnets, that cooperate with vehicle magnetic levitation components 120 of the vehicle 114 to convey the vehicle 114 through the tubes 102 and 104. Alternatively, the guideways 116 may not be configured for magnetic levitation transportation. Instead, the guideways 116 may be rails, tracks, and/or surfaces that are configured to support components, such as wheels, of the vehicle 114.

Each support column 106 includes a weight-bearing main member 122, such as a post, column, bracket, and/or the like, that connects to a tube coupler 124, such as a cradle, clamping bracket, prongs, scaffolds, and/or the like. The support columns 106 are configured to support the weight of the vehicle 114 and the tubes 102 and 104. In this manner, the support columns 106 may be formed of concrete, steel, and/or the like, and extend underneath the ground 126. The support columns 106 are bulky and rigid so that they may support compressive forces exerted therein by the vehicle 114 and the tubes 102 and 104.

Figure 2:
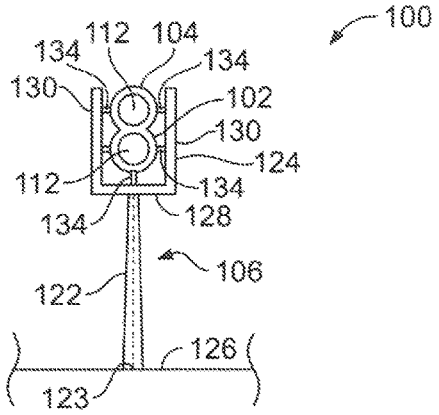
FIG. 2 illustrates an end view of a support column supporting tubes of a transportation system, according to an embodiment of the present disclosure.

FIG. 2 illustrates an end view of a support column 106 supporting the tubes 102 and 104 of the transportation system 100, according to an embodiment of the present disclosure. As shown, the main member 122 is secured into the ground 126. The tube coupler 124 may include a cross beam 128 that may be generally perpendicular to a vertical axis 123 of the main member 122. The cross beam 128 connects to opposed support beams 130. Each support beam 130 may extend upwardly from an end of the cross beam 128. The support beams 130 may be parallel to the vertical axis of the main member 122. The tubes 102 and 104 securely connect to the tube couplers 124 through one or more securing members 134. The securing members 134 may include beams, clamps, fasteners, and/or the like.

Figure 3:
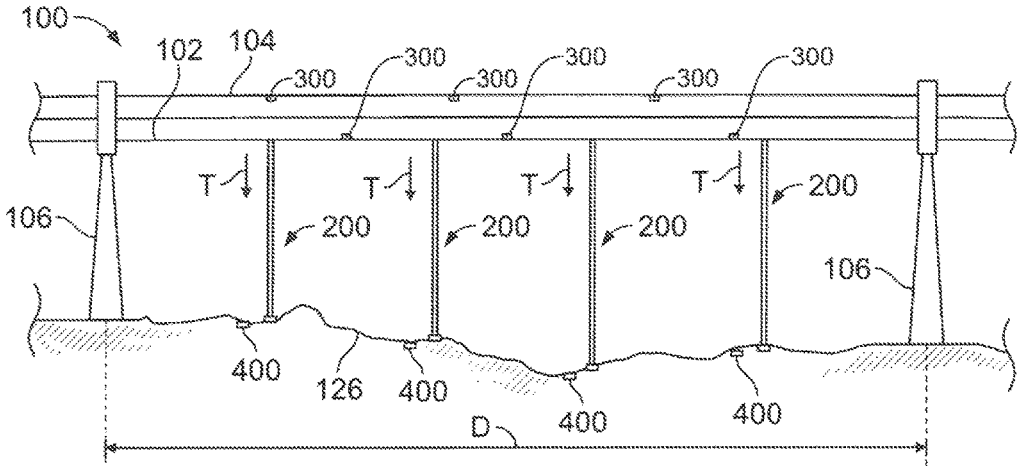
FIG. 3 illustrates a lateral view of a transportation system, according to an embodiment of the present disclosure.

FIG. 3 illustrates a lateral view of the transportation system 100, according to an embodiment of the present disclosure. The transportation system 100 includes one or more tension supports 200 that couple to the tube(s) 102 or 104 between the support columns 106. Each tension support 200 exerts tension T into the tubes 102 and 104. The tension T exerted into the tubes 102 and 104 pulls the tubes 102 and 104 toward the ground 126. The tension supports 200 are different than the support columns 106. The tension supports 200 are substantially lighter and smaller than the support columns 106.

Figure 4:
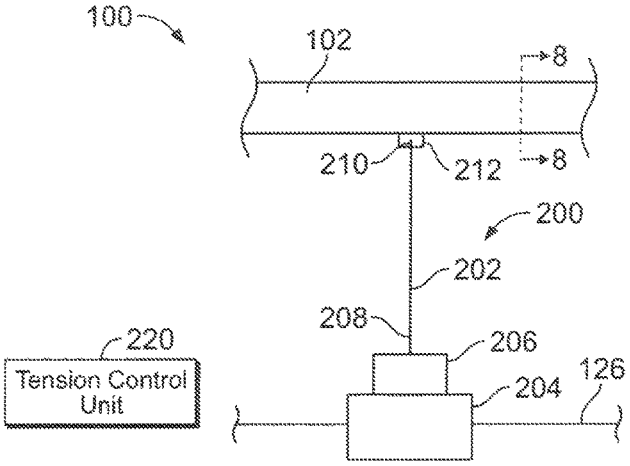
FIG. 4 illustrates a lateral view of a tension support coupling a tube to the ground, according to an embodiment of the present disclosure.

FIG. 4 illustrates a lateral view of a tension support 200 coupling the tube 102 (the tube 104 is not show in FIG. 4) to the ground 126, according to an embodiment of the present disclosure. In at least one embodiment, the tension support 200 includes a tensioning member 202 that connects to an anchor 204 secured to and/or within the ground 126 through a tensioning actuator 206. The tensioning member 202 may be a metal cable(s), metal wire(s), rope(s), a metal rod(s) (hollow or solid), and/or beam(s), for example. The tensioning member 202 is substantially lighter and smaller than the support column 106 (shown in FIG. 2, for example). The axial cross-section of the tensioning member 202 may be circular. Optionally, the axial cross-section of the tensioning member 202 may be various other shapes. Further, each tensioning member may be formed from a single piece and/or material, or multiple pieces and/or materials.

A lower end 208 of the tensioning member 202 is securely coupled to the tensioning actuator 206. An upper end 210 of the tensioning member 202 is securely coupled to the tube 102 through a connection joint 212, which may include one or more brackets, plates, fasteners (such as bolts, welds, adhesives, etc.) and/or the like. The tensioning actuator 206 may be or include one or more of a turnbuckle, bushing (such as a centric bushing), a screwjack, a hydraulic actuator, a pneumatic actuator, a motor (such as a rotary motor), and/or the like that is configured to exert tension in the tensioning member 202. In at least one embodiment, the tensioning actuator 206 may be a moveable component, such as a piston, within the anchor 204, which may include a channel that retains the tensioning member 202. The tensioning member 202 may be configured to move within the anchor 204 to adjust the tension applied to the tensioning member 202. In at least one other embodiment, the tensioning actuator 206 and the anchor 204 may be integrally formed as a single piece. For example, the tensioning actuator 206 may be an integral part of the anchor 204.

Referring to FIGS. 3 and 4, in at least one embodiment, the transportation system 100 may include a tension control unit 220 that is in communication with each tensioning actuators 206 of the tension supports 200, such as through one or more wired or wireless connections. The tension control unit 220 is configured to control the tensioning actuators 206 to adjust the applied tension within the tensioning members 202 based on a location of a vehicle within the tubes 102 and 104, as described below.

Referring again to FIG. 3, the transportation system 100 may include more or less tension supports 200 between the support columns 106 than shown. For example, a single tension support 200 may be coupled to the tubes 102 and 104 between the support columns 106. A distance between neighboring (that is, closest) tension supports 200 may be the same for all neighboring tension supports 200. That is, the distances between neighboring tensions supports 200 may be uniform. Optionally, the distances between tension supports 200 may differ between different neighboring tension supports 200. In at least one embodiment, the spacing between tension supports 200 may differ, and may be based on Gauss quadrature that allows the deflections and slopes of the tubes 102 and 104 to more closely approximate the opposite of a deflected shape resulting from the loads applied by a moving vehicle through the tubes 102 and 104.

Figure 5:
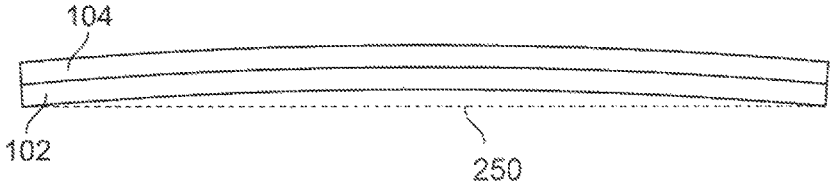
FIG. 5 illustrates a lateral view of tubes in a pre-assembled state, according to an embodiment of the present disclosure.

FIG. 5 illustrates a lateral view of the tubes 102 and 104 in a pre-assembled state, according to an embodiment of the present disclosure. As shown, the tubes 102 and 104 may be formed having a camber or other such arcuate shape. The cambered tubes 102 and 104 may have a constant radius of curvature over a length thereof. Optionally, the radius of curvature may vary over a length of the tubes 102 and 104.

Before being assembled to the tension supports 200 (shown in FIGS. 3 and 4), the cambered shape of the tubes 102 and 104 provides an upwardly arched shape to the tubes 102 and 104. When the tension supports 200 are secured to the tubes 102 and 104 and the ground 126 (shown in FIG. 3), the applied tension force straightens the tubes 102 and 104 so that they exhibit a linear shape 250, in which substantially all of the curvature of the pre-assembled tubes 102 and 104 is eliminated, minimized, or otherwise reduced. Alternatively, the tubes 102 and 104 may be formed having a linear pre-assembled shape.

Referring again to FIGS. 3-5, the support columns 106 are configured to carry compression loads, and are spaced apart from one another a distance D. The tension supports 200 are coupled to the tubes 102 and 104 between the support columns 106. In at least one embodiment, the tension supports 200 are configured to carry only tension, but not compression loads. In at least one other embodiment, the tension supports 200 may be configured to carry tension loads, and a predetermined magnitude of compression loads. In such an embodiment, the tension supports 200 may be configured to carry substantially less compression load than the support columns 106 (in order to ensure that the tension supports 200 are not as large, bulky, and costly as the support columns 106).

As indicated above, after installing cambered tubes 102 and 104 (shown in FIG. 5) between the primary support columns 106, the tension supports 200 are coupled to the tubes 102, 104 and the ground 126. The tensioning actuators 206 are then engaged to increase the tension force T in the tensioning members 202 such that the tensioning members 202 pull the cambered tubes 102 and 104 substantially straight. The amount of camber and the resulting cable tension can be determined so as to accommodate the weight and motion of the vehicle 114 (shown in FIG. 1) as it travels through the tubes 102 and 104.

As the vehicle 114 travels through the tube 102 or 104, the downward force (for example, the weight) of the vehicle 114 exerted into the tubes 102 and 104 and the tension supports 200 is less than the tension force T in the cables. As such, the tensioning members 202 do not slacken and lose their stiffness. For this reason, because of the pre-stress (that is, exerted tension force T) in the tensioning members 202, the stiffness of the tensioning members 202 under the applied compression load from the weight of the vehicle 114 is substantially the same as the tension stiffness of the tensioning members 202. Therefore, the stiffness of the tensioning members 202 greatly reduces the deflections of the tubes 102 and 104 as the vehicle 114 travels through the tube 102 or 104.

In at least one embodiment, each tube 102 and 104 may include sensors 300 secured therein and/or thereon. The sensors 300 may be pressure sensors, weight sensors, velocity sensors, temperature sensors, and/or the like that are configured to detect a location, velocity, and/or acceleration of the vehicle 114 within the tubes 102 and 104. The sensors 300 may be in communication with a control unit, such as the tension control unit 220 shown in FIG. 4. Based on the position of the vehicle 114 within the tubes 102 and 104, the tension control unit 220 may operate the tension actuators 206 of each tension support 200 to adjust the applied tension in the tensioning members 202 to further reduce vertical deflections of the tubes 102 and 104 as the vehicle 114 travels through the tubes 102 and 104.

For example, when the vehicle 114 travels through the tube 102 or 104, the vertical load exerted by the vehicle 114 into the tube 102 or 104 causes the tube 102 or 104 to downwardly deflect. As explained above, the tension supports 200 reduce the downward deflections (as compared to a system without the tension supports), but the moving vehicle 114 may still cause some deflection in the tubes 102 and 104.

Consider a situation in which the vehicle 114 is not within either of the tubes 102 or 104. In this situation, if the tension control unit 220 operates the tension actuators 206 so that the tensioning members 202 loosen, the tubes 102 and 104 upwardly deflect due to less tension force T pulling the tubes 102 and 104 toward the ground 126 (and/or the pre-assembled cambered shape of the tubes 102 and 104, as shown in FIG. 5).

As the vehicle 114 travels through the tubes 102 or 104 over the tension supports 200, the tension control unit 220 adjusts tension in each of the tensioning members 202 (such by loosening tension so that the tension supports 200 upwardly deflect) so that the downward deflections that would otherwise be caused by the motion of the vehicle 114 through the tubes 102 or 104 are offset. That is, the tension control unit 220 adjusts the tension force T in each of the tensioning members 202 to be equal and opposite of the deflections that would otherwise be caused by the moving vehicle 114 as it passes through the tube 102 or 104 over each tension support 202. In this manner, the tension control unit 220, which is in communication with the tension supports 200, may actively control the tensioning actuators 206 to offset deflections within the tubes 102 and 104 caused by the moving vehicle 114. The tension control unit 220 may determine such deflection offsets based on the bending and shear stiffness of the tubes 102 and 104, and the axial stiffness of each of the tensioning members 202. The deflection offsets, as determined by the tension control unit, are a function of time, and vary as the vehicle 114 moves through the tubes 102 and 104.

In the event of disturbance in the ground 126, such as an earthquake, the surface of the ground 126 may move. Especially for vertical motion, the effects of ground motion as a result of an earthquake may affect the passengers or cargo carried in the vehicle 114 if deflections in the tubes 102 and 104 exceed a particular magnitude.

To accommodate earthquake events, for example, the transportation system 100 may also include motion sensors 400 secured in the ground 126 proximate to the anchors 204 of the tension supports 200. The tension control unit 220 is in communication with the sensors 400, such as through one or more wired or wireless connections. The sensors 40 output ground motion signals, which are received by the tension control unit 220. In this manner, the tension control unit 220 may predict the vertical and horizontal motion of the tensioning members 202. Based on the predicted motion of the tensioning members 202, as determined through the motion of the ground 126 as detected by the sensors 400, the tension control unit 220 may adjust the tension force within the tensioning members 202 to offset the motion of the ground 126. As such, the tubes 102 and 104 may experience little to no deflection or motion when the ground 126 moves. In at least one embodiment, the tensioning actuators 206 of each tension support 200 may also include actuators that are configured to actuate the tension members 202 laterally, as well as vertically, in order to offset motion of the ground 126.

As used herein, the term "controller," "control unit," "central processing unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the tension control unit 220 may be or include one or more processors that are configured to control operation of the tensioning actuators 206 of the tension supports 200, as described above.

In at least one embodiment, the tension control unit 220 may utilize solutions generated by finite element analysis of ground motions and structural features (for example, stiffness and mass) of the tubes, supports, vehicles, and the like. In at least one embodiment, finite element models may be used to calculate the transfer functions used by the tension control unit 220 for a variety of vehicle speeds and weights. The finite element models may be stored in a memory of and/or otherwise coupled to the tension control unit 220.

The tension control unit 220 is configured to execute a set of instructions that are stored in one or more data storage units or elements (such as one or more memories), in order to process data. For example, the tension control unit 220 may include or be coupled to one or more memories. The data storage units may also store data or other information as desired or needed. The data storage units may be in the form of an information source or a physical memory element within a processing machine.

The set of instructions may include various commands that instruct the tension control unit 220 as a processing machine to perform specific operations such as the methods and processes of the various examples of the subject matter described herein. The set of instructions may be in the form of a software program. The software may be in various forms such as system software or application software. Further, the software may be in the form of a collection of separate programs, a program subset within a larger program, or a portion of a program. The software may also include modular programming in the form of object-oriented programming. The processing of input data by the processing machine may be in response to user commands, or in response to results of previous processing, or in response to a request made by another processing machine.

The diagrams of examples herein may illustrate one or more control or processing units, such as the tension control unit 220. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the tension control unit 220 may represent processing circuitry such as one or more of a field programmable gate array (FPGA), application specific integrated circuit (ASIC), microprocessor(s), and/or the like. The circuits in various examples may be configured to execute one or more algorithms to perform functions described herein. The one or more algorithms may include aspects of examples disclosed herein, whether or not expressly identified in a flowchart or a method.

As used herein, the terms "software" and "firmware" are interchangeable, and include any computer program stored in a data storage unit (for example, one or more memories) for execution by a computer, including RAM memory, ROM memory, EPROM memory, EEPROM memory, and non-volatile RAM (NVRAM) memory. The above data storage unit types are exemplary only, and are thus not limiting as to the types of memory usable for storage of a computer program.

Figure 6:
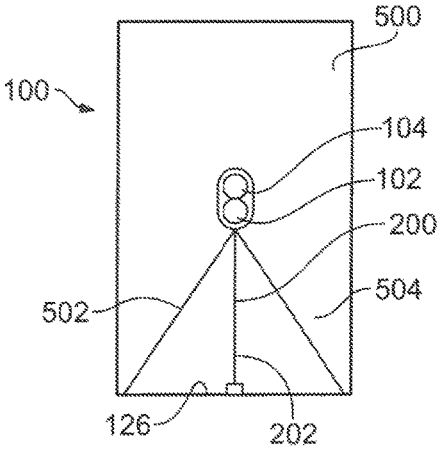
FIG. 6 illustrates an end view of a tension support, according to an embodiment of the present disclosure.

FIG. 6 illustrates an end view of a tension support 200, according to an embodiment of the present disclosure. The tension support 200 may be used to support the tubes 102 and 104 within water 500, such that the ground 126 is a sea floor. The transportation system 100 may also include stabilizing supports 502 and 504 that extend underneath the tubes 102 and 104 on opposite sides of the tension support 200. The stabilizing supports 502 and 504 couple to the sea floor 126 on opposite sides of the tension support 200 to ensure that the tubes 102 and 104 remain in a vertically-upright position. As shown, the stabilizing supports 502 and 504 extend diagonally from the tubes 102 and 104 to the sea floor 126.

When underwater, the transportation system 100 may not include the support columns 106 (shown in FIG. 1, for example). Instead, the tension supports 200 may wholly couple the tubes 102 and 104 to the sea floor 126. Because the buoyancy of the tubes 102 and 104 displaces a volume of water, tension is present in each of the tension supports 200 (such as within the tensioning members 202).

Figure 7:
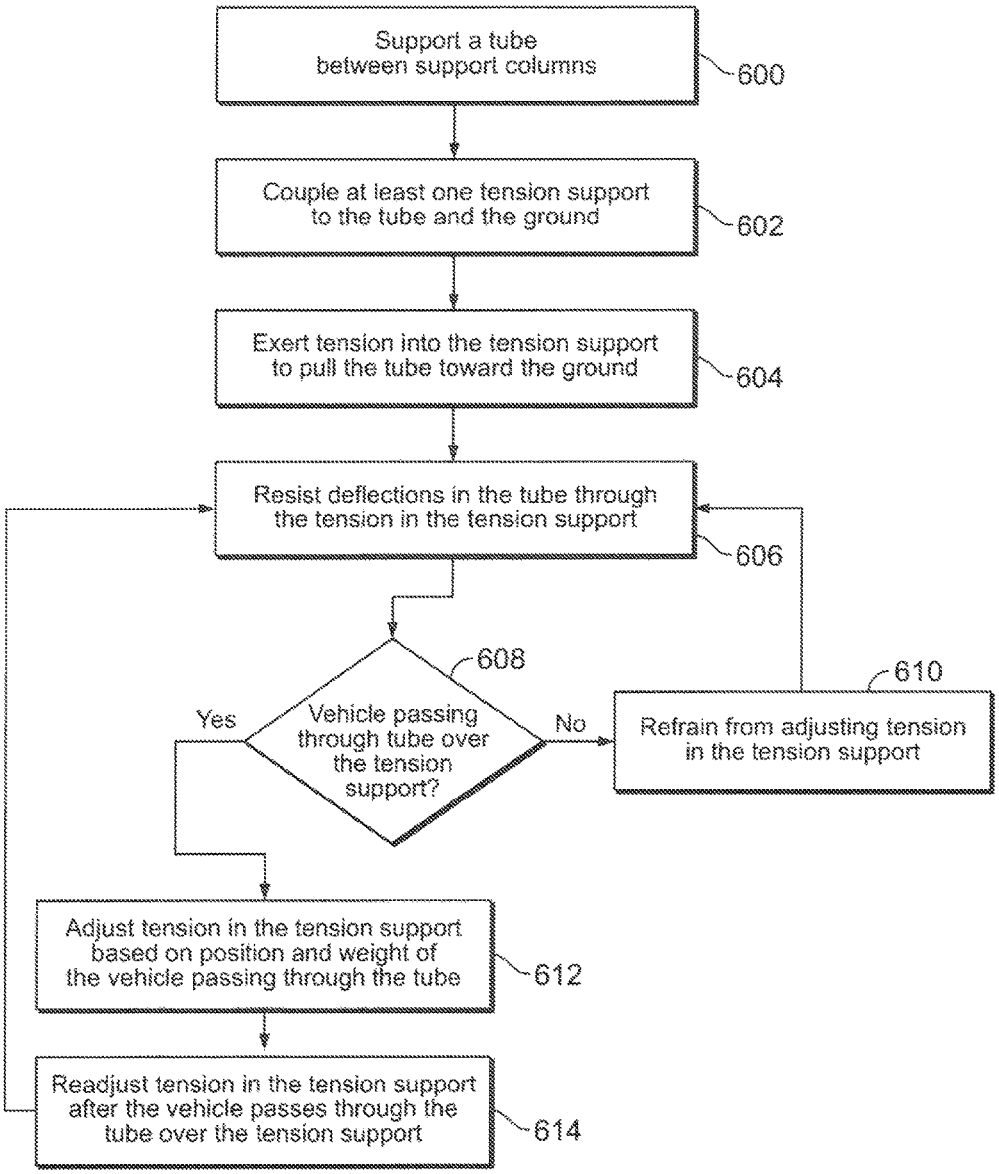
FIG. 7 illustrates a flow chart of a method of supporting one or more tubes of a transportation system, according to an embodiment of the present disclosure.

FIG. 7 illustrates a flow chart of a method of supporting one or more tubes of a transportation system, according to an embodiment of the present disclosure. Referring to FIGS. 1-7, the method begins at 600, in which a tube 102 or 104 is supported between support columns 106. Alternatively, the method may not include 600 (such as if the transportation system 100 is underwater).

At 602, at least one tension support 200 is coupled to the tube 102 or 104 and the ground 126. At 604, tension is exerted into the tension support 200 (such as via a tension actuator 206) to pull the tube 102 or 104 toward the ground 126. For example, the applied tension may straighten a cambered shape of the tube 102 or 104. At 606, deflections in the tube 102 or 104 are resisted through the applied tension in the tension support 606.

At 608, the tension control unit 220 determines whether the vehicle 114 is passing through the tube 102 or 104 over the tension support 200. If not, the method proceeds to 610, in which the tension control unit 220 refrains from adjusting tension in the tension support 200, and the method returns to 606.

If, however, the tension control unit 220 determines that the vehicle is passing through the tube 102 or 104 over the tension support 608, the tension control unit 220 adjusts tension in the tension support based on the position and weight of the vehicle passing through the tube 102 or 104 at 612, in order to eliminate, minimize, or otherwise reduce potential deflections of the tube 102 or 104. The method then proceeds to 614, at which the tension control unit 220 readjusts the tension in the tension support 200 after the vehicle 114 passes through the tube 102 or 104 over the tension support 200. The method then returns to 606.

Figure 8:
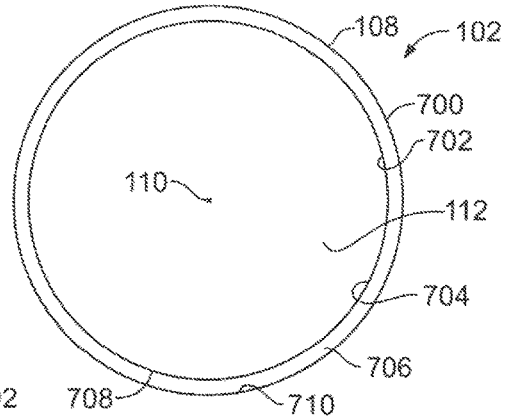
FIG. 8 illustrates an axial cross sectional view of a tube through line 8-8 of FIG. 4, according to an embodiment of the present disclosure.

FIG. 8 illustrates an axial cross sectional view of the tube 102 (or 104) through line 8-8 of FIG. 4, according to an embodiment of the present disclosure. The tube 102 includes an outer circumferential wall 108 that extends longitudinally along and around a longitudinal axis 110. The tube 102 includes the hollow interior channel 112. As indicated, the interior channel 112 may be a vacuum channel. That is, a vacuum may exist within the interior channel 112.

The outer circumferential wall 108 may be formed by an outer tube 700 that surrounds an inner tube 702. The outer tube 700 and the inner tube 702 may be concentric. An interior surface 704 of the inner tube 702 defines the interior channel 112. The outer circumferential wall 108 may overlay the inner tube 702. In at least one embodiment, the outer tube 700 is separated from the inner tube 702 by a space 706, which may be a vacuum space. The outer tube 702 may securely couple to the inner tube 702 through one or more stabilizers (such as fins, beams, ridges, ribs, or the like) disposed between an outer surface 708 of the inner tube 702 and an inner surface 710 of the outer tube 702.

In operation, the outer tube 700 protects the inner tube 702 from being damaged. For example, the outer tube 700 provides a covering shield that protects the inner tube 702 from being perforated, punctured, or otherwise compromised. In this manner, the outer tube 700 ensures that air does not enter the interior vacuum channel 112, such as through a leak.

The double-walled construction of the tube 102 provides wall redundancy that protects against a rapid loss of pressure, and increases the structural stability of the tube 102. Alternatively, the tube 102 may be formed as a single wall tube.

Figure 9:
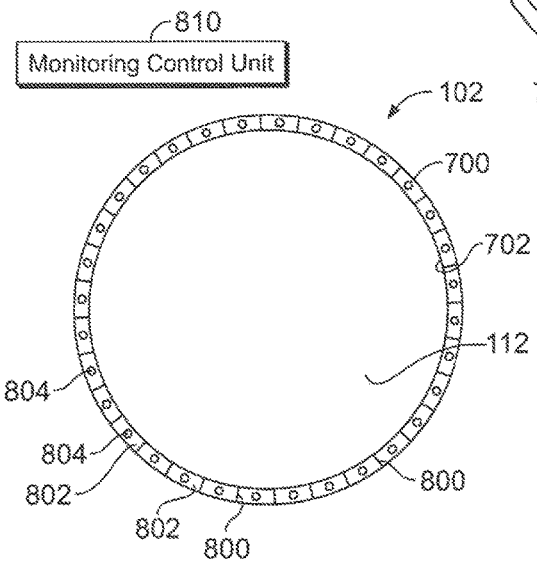
FIG. 9 illustrates an axial cross sectional view of a tube through line 8-8 of FIG. 4, according to an embodiment of the present disclosure.

FIG. 9 illustrates an axial cross sectional view of the tube 102 through line 8-8 of FIG. 4, according to an embodiment of the present disclosure. As shown in FIG. 9, a plurality of stabilizers, such as planar fins 800, may connect the outer tube 700 to the inner tube 702. The fins 800 may be flat plates, ridges, ribs, or the like extending between the outer tube 700 and the inner tube 702. The fins 800 provide stiffening structures that stably couple the outer tube 700 to the inner tube 702.

In at least one embodiment, the fins 800 define a plurality of sealed compartments or cavities 802 between the outer tube 700 and the inner tube 702. One or more sensors 804 may be secured within each compartment 802. The sensors 804 may be fluid sensors (such as air or water sensors), pressure sensors, temperature sensors, and/or the like that are configured to output signals that are received by a monitoring control unit 810 that monitors the sensors 804. By monitoring the output signals, the monitoring control unit 810 determines the integrity of the vacuum within the interior channel 112. For example, the monitoring control unit 810 may determine that the outer tube 700 and the inner tube 702 are contiguous and stable (and therefore a vacuum is maintained within the interior channel 112) when the signals received from the sensors 804 are at a predetermined level or within a predetermined acceptable range. If, however, one of the signals from the sensors 804 is below or above the predetermined level or range, the monitoring control unit 810 determines that the outer tube 700 and/or the inner tube 702 has been damaged proximate to the sensor 804 that outputs the out-of-range signal. In this manner, the monitoring control unit 810 is able to locate an area of the tube 102 that is to be repaired or replaced.

The tube 102 may include more or less sensors 804 than shown. For example, less than all of the compartments 802 may include a sensor 804.

Figure 10:
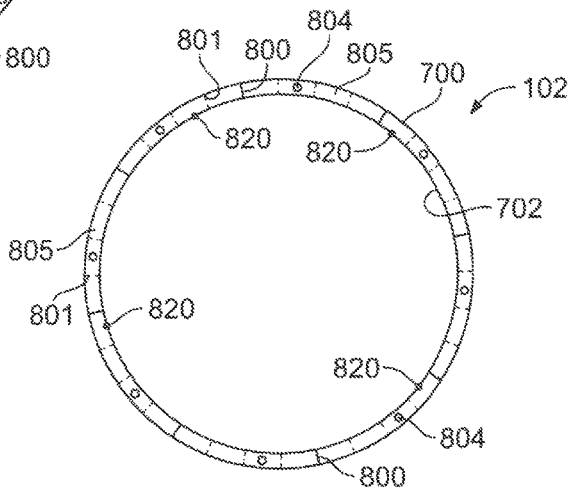
FIG. 10 illustrates an axial cross sectional view of a tube through line 8-8 of FIG. 4, according to an embodiment of the present disclosure.

FIG. 10 illustrates an axial cross sectional view of the tube 102 through line 8-8 of FIG. 4, according to an embodiment of the present disclosure. In this embodiment, solid fins 800 may extend between the outer tube 700 and the inner tube 702. Opened fins 801 (that is, fins having at least one opening formed therein) may be positioned between solid fins 800. The open fins 801 allow fluid communication through the openings. In this manner, extended compartments 805 may be defined between the solid fins 800. One or more sensors 804 may be positioned within each compartment 805. Optionally, the tube 102 may not include the opened fins 801.

Referring to FIGS. 8-10, in at least one embodiment, the connection between each fin 800 and the outer and inner tubes 700 and 702 is such that the compartments 802 (or 805) are fluid-tight. The space between the tubes 700 and 702 may be divided into a plurality of individual sections, each sealed with respect to the ambient atmosphere exterior to the outer tube 700, the vacuum interior to the inner tube 702, and each other. A sensor 804 that is capable of detecting fluid (such as air or water) is placed in each of the individual volumes (as shown in FIG. 9). As such, the sensor 804 is able to detect leaks in the outer tube 700 proximate to the compartment 802 or 805 in which the sensor 804 is located. As such, each sensor 804 is able to isolate a location of a detected leak.

Further, the compartments 802 or 805 may be used to set and/or maintain the vacuum in the interior channel 112 at a desired level. For example, if a section of the tube 102 is opened to ambient air (for example, routine maintenance or damage to the tube 102), the compartments 802 or 805 in the tube 102 may be used to quickly bring the interior channel 112 back to a desired degree of vacuum in a relatively short amount of time.

For example, the space 706 may be separated into four vacuum sections. The four different vacuum sections may have vacuums at, for example, $10^{-1}$ atm, $10^{-2}$ atm, $10^{-3}$ atm, and $10^{-4}$ atm. Optionally, the space 706 may be separated into more or less vacuum sections at different pressures than listed.

After the tube 102 has been serviced or repaired, for example, the interior channel 112 may be at ambient pressure. Each vacuum section may include a valve 820 (shown in FIG. 10) that fluidly couples the vacuum section to the interior channel 112. A valve 820 is opened to the vacuum section at which the pressure is at a first degree of vacuum (such as $10^{-1}$ atm). The air from the interior channel 112 moves into the vacuum section via the open valve until the pressure in the interior channel 112 is approximately $10^{-1}$ atm. The valve may then be closed. The process repeats with respect to each section in order to achieve different degrees of vacuum within the interior channel 112.

In at least one embodiment, the inner and outer tube thicknesses may be the same. Each tube 700 and 702 may be formed of a metal, such as steel. However, the thicknesses of the inner and outer tubes 700 and 702 may be different, and each may be formed of a different material. For example, the outer tube 700 may be reinforced concrete, while the inner tube 702 may be formed of metal.

The interior stiffeners (such as the fins 800) may also be of a different material compared to either the inner and outer tubes 700 and 702. The stiffeners may be formed from a material that has a low thermal conductivity, so that the inner and outer tubes 700 and 702 are thermally isolated, thereby allowing a temperature of the interior tube 702 to be more easily controlled.

The double-walled construction of the tube 102 provides a safe and effective transportation system in that the outer tube 700 protects the inner tube 702 from damage, and maintains the integrity of the vacuum within the interior channel 112. The stiffeners (such as the fins 800) couple the tubes 700 and 702 together while reducing an overall weight of the tube 102 (as compared a single wall having an increased thickness).

As described above with respect to FIGS. 1-10, embodiments of the present disclosure provide systems and methods for supporting one or more tubes of a transportation system. The systems and methods reduce deflections as a vehicle travels through the tube in an efficient and cost-effective manner.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A transportation system, comprising:

a tube defining an interior channel, wherein a vehicle is configured to travel through the interior channel;

at least one tension support that couples the tube to ground, wherein the at least one tension support exerts tension force into the tube, and wherein the tension force exerted into the tube reduces deflection of the tube when the vehicle travels through the interior channel over the at least one tension support; and a tension control unit in communication with the at least one tension support, wherein the tension control unit is configured to adjust the tension force of the at least one tension support based on a position and weight of the vehicle within the interior channel of the tube.

2. The transportation system of claim 1, further comprising at least two support columns, wherein the tube extends between the at least two support columns, and wherein the at least one tension support couples to the tube between the at least two support columns.

3. The transportation system of claim 2, wherein the at least two support columns are configured to carry compression loads, and wherein the at least one tension support is configured to carry tension loads.

4. The transportation system of claim 2, wherein the at least one tension support is lighter and smaller than each of the at least two support columns.

5. The transportation system of claim 1, wherein a vacuum is formed in the interior channel, wherein the vacuum reduces aerodynamic drag on the vehicle as the vehicle travels through the interior channel.

6. The transportation system of claim 1, wherein the vehicle is a magnetic levitation vehicle.

7. The transportation system of claim 1, wherein the at least one tension support comprises:

an anchor secured to the ground;

a tensioning actuator coupled to the anchor; and a tensioning member having a first end coupled to the tensioning actuator, and a second end coupled to the tube.

8. The transportation system of claim 1, further comprising a plurality of sensors coupled to the tube, wherein the plurality of sensors are configured to detect a location of the vehicle within the interior channel, and wherein the tension control unit is in communication with the plurality of sensors.

9. The transportation system of claim 1, further comprising at least one motion sensor secured to the ground proximate to the at least one tension support, wherein the at least one motion sensor is configured to detect motion of the ground, and wherein the tension control unit is in communication with the at least motion sensor and is configured to adjust the tension force based on the motion of the ground as detected by the at least one motion sensor.

10. The transportation system of claim 1, wherein the tube is cambered before being coupled to the at least one tension support, wherein the tension force exerted into the tube by the at least one tension support straightens the tube.

11. The transportation system of claim 1, wherein the tube comprises an outer tube surrounding an inner tube.

12. The transportation system of claim 11, wherein the outer tube is separated from the inner tube by a space.

13. The transportation system of claim 12, wherein the tube further comprises a plurality of stiffeners within the space between the outer tube and the inner tube, wherein the plurality of stiffeners define a plurality of sealed compartments.

14. The transportation system of claim 13, wherein the tube further comprises at least one fluid sensor within at least one of the plurality of sealed compartments.

15. The transportation system of claim 12, wherein the space is divided into a plurality of vacuum sections, wherein each of the plurality of vacuum sections includes a different degree of vacuum, and wherein the different degrees of vacuum within the plurality of vacuum sections are configured to set a vacuum within the interior channel to a desired level.

16. A method of supporting a transportation system, the method comprising:

coupling a tube defining an interior channel to ground with at least one tension support, wherein a vehicle is configured to travel through the interior channel;

exerting tension force into the tube through the coupling;

reducing deflection of the tube through the exerting when the vehicle travels through the interior channel over the at least one tension support;

communicatively coupling a tension control unit with the at least one tension support; and using the tension control unit to adjust the tension force of the at least one tension support based on a position and weight of the vehicle within the interior channel of the tube.

17. The method of claim 16, further comprising:

supporting the tube between at least two support columns;

carrying compression loads by the at least two support columns; and carrying tension loads by at least one tension support.

18. The method of claim 16, further comprising:

securing at least one motion sensor to the ground proximate to the at least one tension support;

communicatively coupling the tension control unit with the at least one motion sensor;

using the motion sensor to detect motion of the ground; and using the tension control unit to adjust the tension force based on the motion of the ground as detected by the at least one motion sensor.

19. The method of claim 16, further comprising straightening a camber of the tube through the exerting.

20. The method of claim 16, surrounding an inner tube of the tube with an outer tube.

21. The method of claim 20, further comprising:

connecting the outer tube to the inner tube with a plurality of stiffeners within a space between the outer tube and the inner tube; and defining a plurality of sealed compartments with the plurality of stiffeners.

22. The method of claim 21, further comprising positioning at least one fluid sensor within at least one of the plurality of sealed compartments.

23. The method of claim 21, further comprising:

dividing the space into a plurality of vacuum sections;

varying a degree of vacuum within each of plurality of vacuum sections;

using the varying degrees of vacuum within the plurality of vacuum sections to set a vacuum within the interior channel to a desired level.

24. A transportation system, comprising:

a tube defining an interior channel, wherein a vacuum is formed in the interior channel;

a vehicle within the interior channel, wherein the vehicle is a magnetic levitation vehicle, wherein the vehicle is configured to travel through the interior channel, wherein the vacuum reduces aerodynamic drag on the vehicle as the vehicle travels through the interior channel;

a plurality of tension supports that couple the tube to ground, wherein each of the plurality of tension support exerts tension force into the tube, wherein the tension force exerted into the tube reduces deflection of the tube when the vehicle travels through the interior channel over each of the plurality of tension supports, wherein the tube is cambered before being coupled to the plurality of tension supports, wherein the tension force exerted into the tube by the plurality of tension supports straightens the tube;

at least two support columns, wherein the tube extends between the at least two support columns, and wherein the plurality of tension supports couple to the tube between the at least two support columns, wherein the at least two support columns are configured to carry compression loads;

a tension control unit in communication with each of the plurality of tension supports, wherein the tension control unit is configured to adjust the tension force of the plurality of tension supports based on a position and weight of the vehicle within the interior channel of the tube; and a plurality of motion sensors secured to the ground proximate to the plurality of tension supports, wherein each of the plurality of motion sensors is configured to detect motion of the ground, and wherein the tension control unit is in communication with the plurality of motion sensors and is configured to adjust the tension force based on the motion of the ground as detected by the plurality of motion sensors.

25. The transportation system of claim 24, wherein each of the plurality of tension supports comprises:

an anchor secured to the ground;

a tensioning actuator coupled to the anchor; and a tensioning member having a first end coupled to the tensioning actuator, and a second end coupled to the tube.

26. The transportation system of claim 24, wherein the tube comprises:

an outer tube surrounding an inner tube, wherein the outer tube is separated from the inner tube by a space;

a plurality of stiffeners within the space between the outer tube and the inner tube, wherein the plurality of stiffeners define a plurality of sealed compartments; and at least one fluid sensor within at least one of the plurality of sealed compartments.

27. The transportation system of claim 26, wherein the space is divided into a plurality of vacuum sections, wherein each of the plurality of vacuum sections includes a different degree of vacuum, and wherein the different degrees of vacuum within the plurality of vacuum sections are configured to set a vacuum within the interior channel to a desired level.

28. A transportation system, comprising:

a tube defining an interior channel, wherein a vehicle is configured to travel through the interior channel, wherein the tube comprises an outer tube surrounding an inner tube, wherein the outer tube is separated from the inner tube by a space that is divided into a plurality of vacuum sections, wherein each of the plurality of vacuum sections includes a different degree of vacuum, and wherein the different degrees of vacuum within the plurality of vacuum sections are configured to set a vacuum within the interior channel to a desired level; and at least one tension support that couples the tube to ground, wherein the at least one tension support exerts tension force into the tube, and wherein the tension force exerted into the tube reduces deflection of the tube when the vehicle travels through the interior channel over the at least one tension support.

29. The transportation system of claim 28, wherein the vacuum within the interior channel reduces aerodynamic drag on the vehicle as the vehicle travels through the interior channel.

30. A method of supporting a transportation system, the method comprising:

coupling a tube defining an interior channel to ground with at least one tension support, wherein a vehicle is configured to travel through the interior channel;

securing at least one motion sensor to the ground proximate to the at least one tension support;

communicatively coupling a tension control unit with the at least one motion sensor;

exerting tension force into the tube through the coupling;

using the at least one motion sensor to detect motion of the ground;

reducing deflection of the tube through the exerting when the vehicle travels through the interior channel over the at least one tension support; and using the tension control unit to adjust the tension force based on the motion of the ground as detected by the at least one motion sensor.

31. The method of claim 30, further comprising straightening a camber of the tube through the exerting.

32. The method of claim 30, surrounding an inner tube of the tube with an outer tube.

33. The method of claim 32, further comprising:

connecting the outer tube to the inner tube with a plurality of stiffeners within a space between the outer tube and the inner tube; and defining a plurality of sealed compartments with the plurality of stiffeners.

34. The method of claim 33, further comprising positioning at least one fluid sensor within at least one of the plurality of sealed compartments.

35. The method of claim 33, further comprising:

dividing the space into a plurality of vacuum sections;

varying a degree of vacuum within each of plurality of vacuum sections;

using the varying degrees of vacuum within the plurality of vacuum sections to set a vacuum within the interior channel to a desired level.

36. A method of supporting a transportation system, the method comprising:

coupling a tube defining an interior channel to ground with at least one tension support, wherein a vehicle is configured to travel through the interior channel;

surrounding an inner tube of the tube with an outer tube;

connecting the outer tube to the inner tube with a plurality of stiffeners within a space between the outer tube and the inner tube;

defining a plurality of sealed compartments with the plurality of stiffeners;

dividing the space into a plurality of vacuum sections;

varying a degree of vacuum within each of plurality of vacuum sections;

using the varying degrees of vacuum within the plurality of vacuum sections to set a vacuum within the interior channel to a desired level;

exerting tension force into the tube through the coupling; and reducing deflection of the tube through the exerting when the vehicle travels through the interior channel over the at least one tension support.

* * * * *